US007913590B2

(12) United States Patent
Lin

(10) Patent No.: US 7,913,590 B2
(45) Date of Patent: Mar. 29, 2011

(54) SOCKET APPARATUS

(75) Inventor: Da-Sen Lin, Taichung (TW)

(73) Assignee: Jing Xiang Kai Industry Co., Ltd., Taichung (TW)

( * ) Notice: Subject to any disclaimer, the term of this patent is extended or adjusted under 35 U.S.C. 154(b) by 152 days.

(21) Appl. No.: 12/372,984

(22) Filed: Feb. 18, 2009

(65) Prior Publication Data

US 2010/0206140 A1 Aug. 19, 2010

(51) Int. Cl.
*B25B 13/06* (2006.01)

(52) U.S. Cl. ..... 81/121.1; 81/177.85

(58) Field of Classification Search ..... 81/177.85, 81/121.1; 279/79; 403/294, 324, 325
See application file for complete search history.

(56) References Cited

U.S. PATENT DOCUMENTS

| | | | | | |
|---|---|---|---|---|---|
| 2,304,038 | A * | 12/1942 | Thompson | 403/324 |
| 2,987,334 | A * | 6/1961 | Wendling | 403/8 |
| 4,266,453 | A * | 5/1981 | Farley | 81/177.85 |
| 4,699,029 | A * | 10/1987 | Kelly et al. | 81/121.1 |
| 4,932,293 | A * | 6/1990 | Goff | 81/177.85 |
| 5,481,949 | A * | 1/1996 | Yen | 81/438 |
| 5,595,099 | A * | 1/1997 | Pusateri | 81/177.85 |
| 7,028,589 | B1 * | 4/2006 | Cheng | 81/177.85 |
| 7,143,669 | B2 * | 12/2006 | Hu | 81/60 |
| 2003/0056625 | A1 * | 3/2003 | Bizilia et al. | 81/177.85 |
| 2008/0295650 | A1 * | 12/2008 | Hsieh | 81/177.85 |

* cited by examiner

*Primary Examiner* — David B Thomas

(57) ABSTRACT

A socket apparatus includes a socket, at least one detent and an elastic element. The socket includes a bit-receiving recess in an end, a mandrel-receiving recess in an opposite end, at least one vent in communication with the mandrel-receiving recess and at least one aperture in communication with the mandrel-receiving recess. The detent is inserted in the aperture so that the detent includes a portion disposed in the mandrel-receiving recess. The elastic element is used to bias and keep the detent in the aperture.

6 Claims, 8 Drawing Sheets

SOCKET APPARATUS

BACKGROUND OF INVENTION

1. Field of Invention

The present invention relates to a socket apparatus and, more particularly, to a socket apparatus for firm connection to a pneumatic or electrical tool.

2. Related Prior Art

Disclosed in Taiwanese Patent M346494 is a socket for connection to a pneumatic or electrical tool. The socket includes a first section for receiving a mandrel of the pneumatic or electrical tool and a second section for receiving a bit. The first section of the socket includes a vent for releasing pressurized air when the socket is used together with a pneumatic tool. In this case, a detent is provided on the mandrel of the pneumatic tool. The detent is inserted in the vent to keep the socket on the mandrel, and this is however inadequate.

Therefore, the present invention is intended to obviate or at least alleviate the problems encountered in prior art.

SUMMARY OF INVENTION

It is the primary objective of the present invention to provide a socket apparatus for firm connection to a pneumatic or electrical tool.

To achieve the foregoing objective, the socket apparatus includes a socket, at least one detent and an elastic element. The socket includes a bit-receiving recess in an end, a mandrel-receiving recess in an opposite end, at least one vent in communication with the mandrel-receiving recess and at least one aperture in communication with the mandrel-receiving recess. The detent is inserted in the aperture so that the detent includes a portion disposed in the mandrel-receiving recess. The elastic element is used to bias and keep the detent in the aperture.

Other objectives, advantages and features of the present invention will become apparent from the following description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
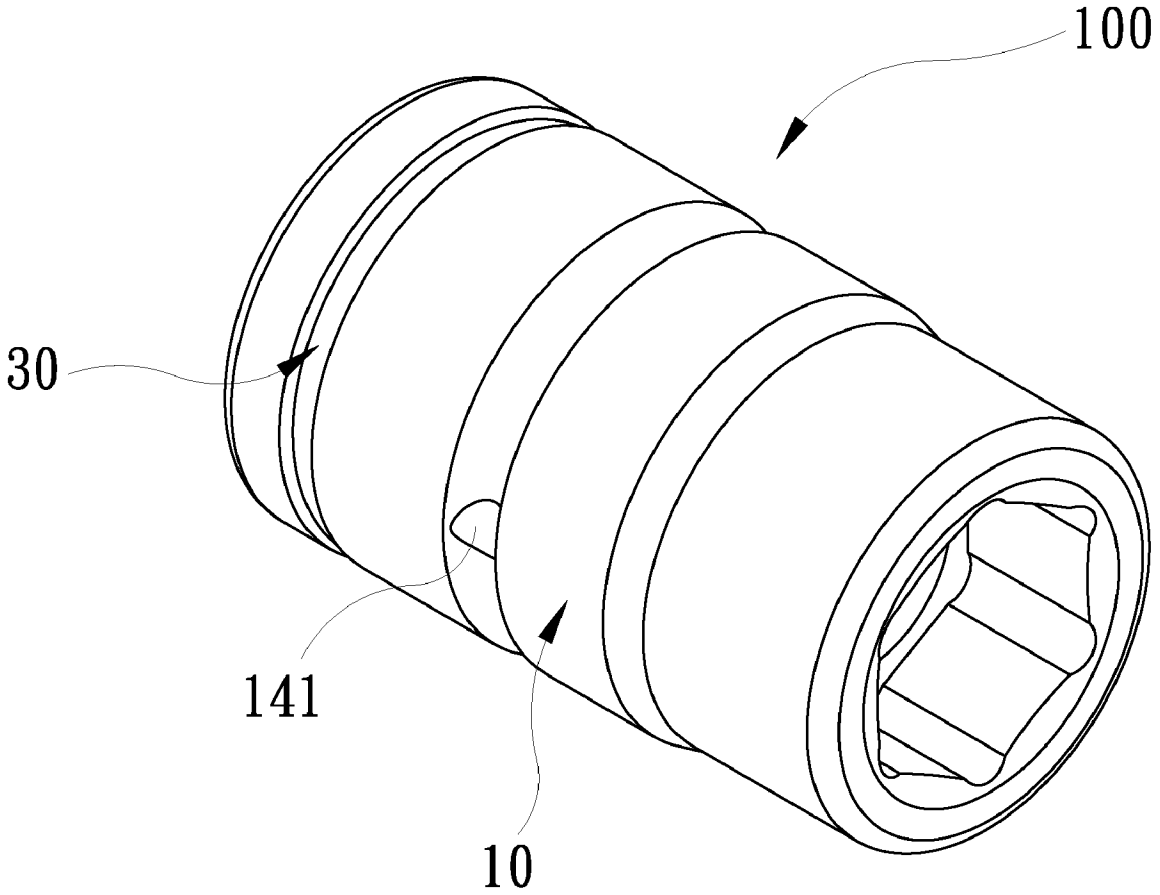
FIG. 1 is a perspective view of a socket apparatus according to the preferred embodiment of the present invention.
Figure 2:
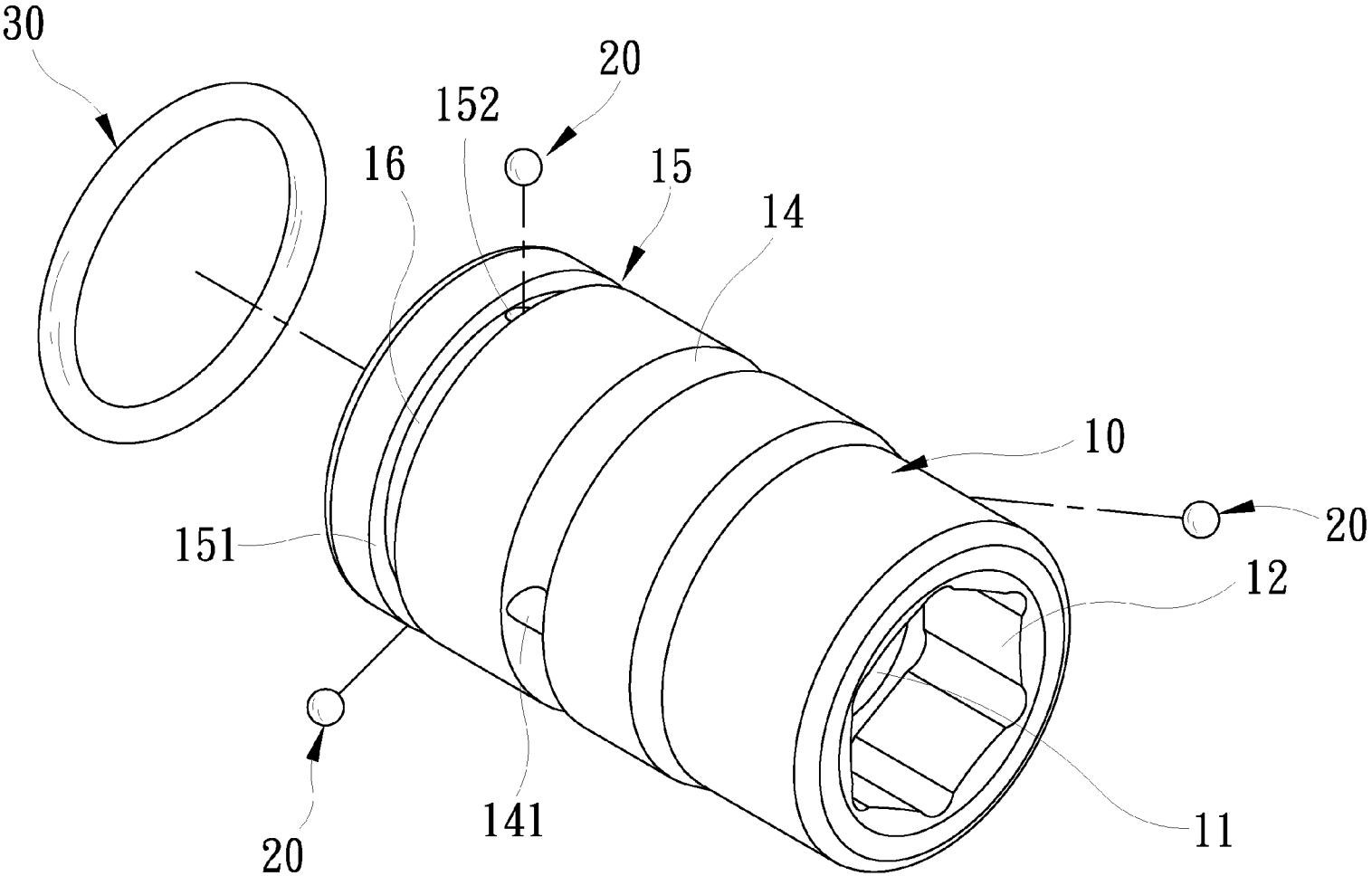
FIG. 2 is an exploded view of the socket apparatus shown in FIG. 1.
Figure 3:
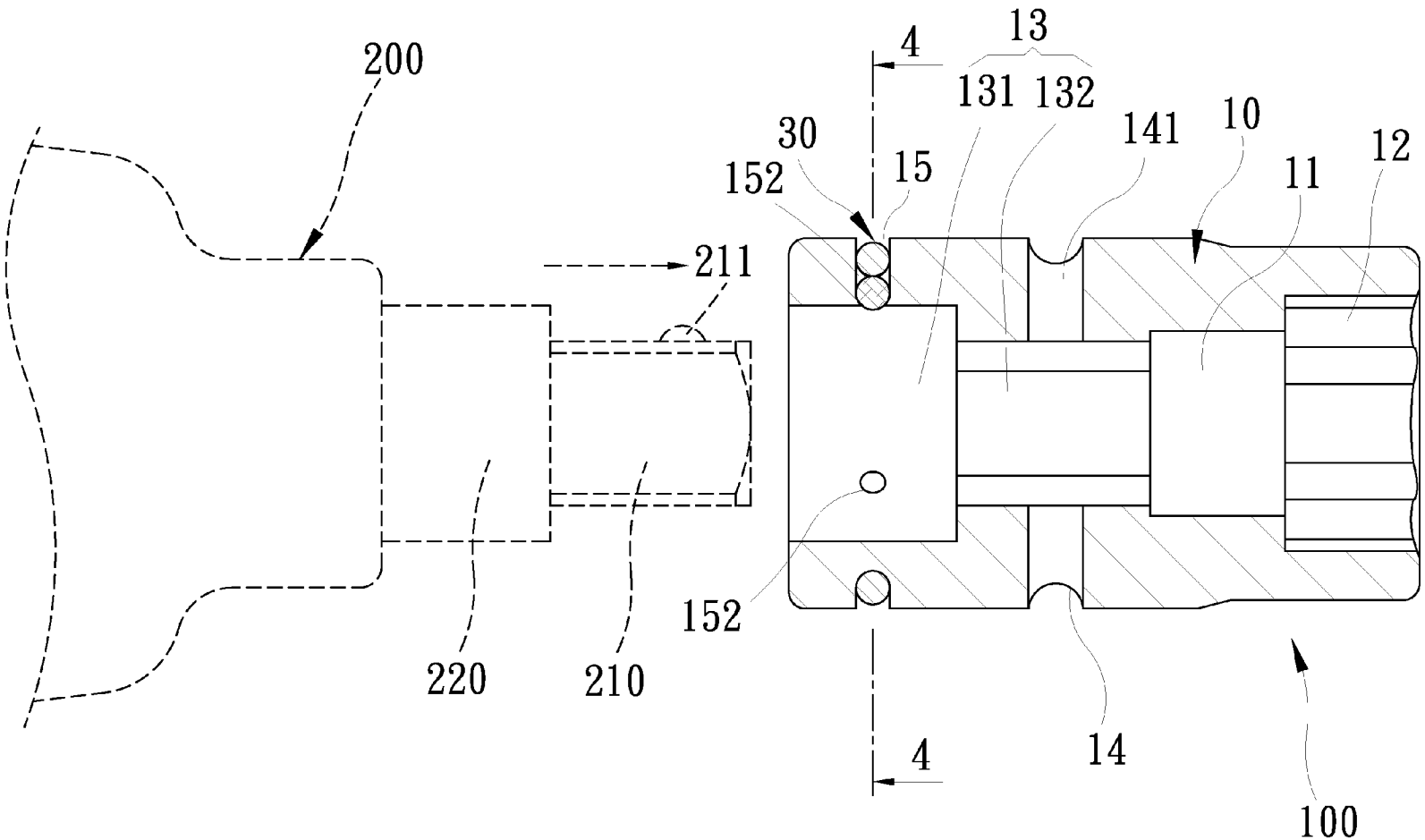
FIG. 3 is a cross-sectional view of a pneumatic tool and the socket apparatus shown in FIG. 1.

Referring to FIGS. 1 through 3, a socket apparatus 100 includes a socket 10, detents 20 and an elastic element 30 according to the preferred embodiment. The socket 10 includes a bit-receiving recess 12 defined in an end, a mandrel-receiving recess 13 defined in an opposite end and a space 11 in communication with both of the recesses 12 and 13. The mandrel-receiving recess 13 includes a substantially square section 132 and a circular section 131.

A groove 14 is annularly defined in the periphery of the socket 10. At least one vent 141 is defined in the periphery of the socket 10. The vent 141 is in communication with the groove 14 on one hand and in communication with the square section 132 of the mandrel-receiving recess 13 on the other hand.

A groove 15 is annularly defined in the periphery of the socket 10. The groove 15 is defined by two walls 151 and a floor 16. Apertures 152 are defined in the periphery of the socket 10 so that they are in communication with the groove 15 on one hand and in communication with the circular section 131 of the mandrel-receiving recess 13 on the other hand. Each of the apertures 152 includes a reduced end near the circular section 131 of the mandrel-receiving recess 13.

The elastic element 30 is preferably an elastic ring. Alternatively, the elastic element 30 may be a C-clip or a rubber band.

Figure 4:
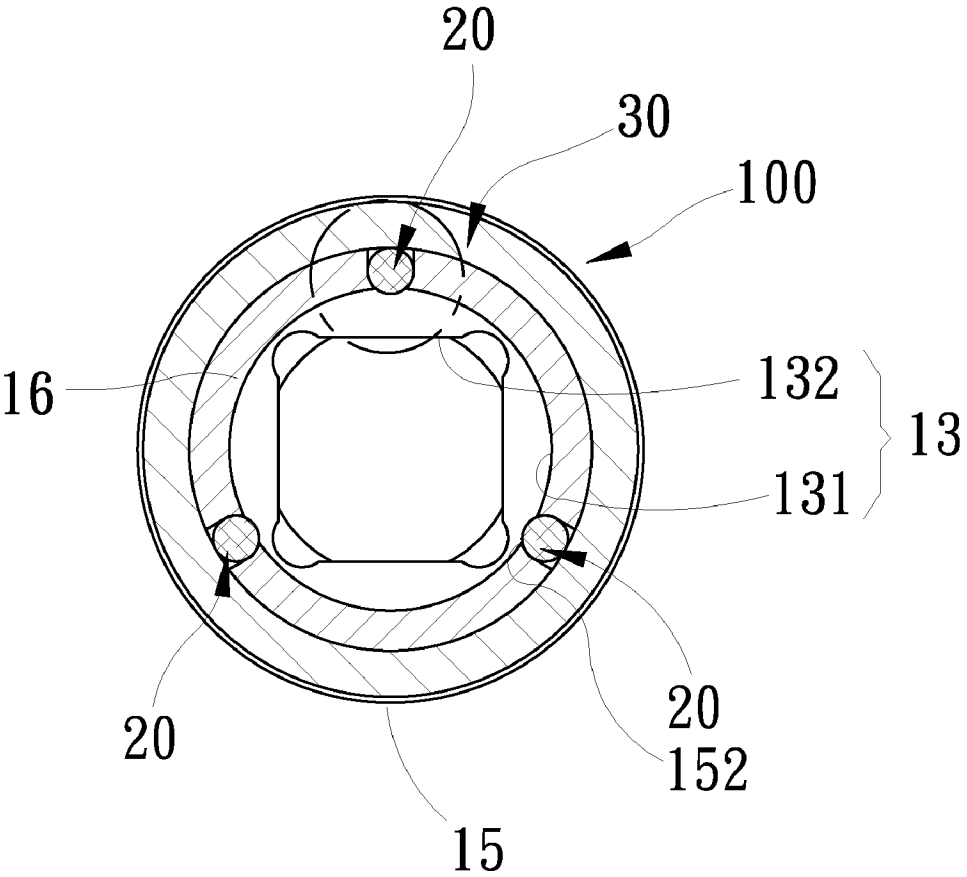
FIG. 4 is another cross-sectional view of the pneumatic tool and the socket apparatus shown in FIG. 3.
Figure 5:
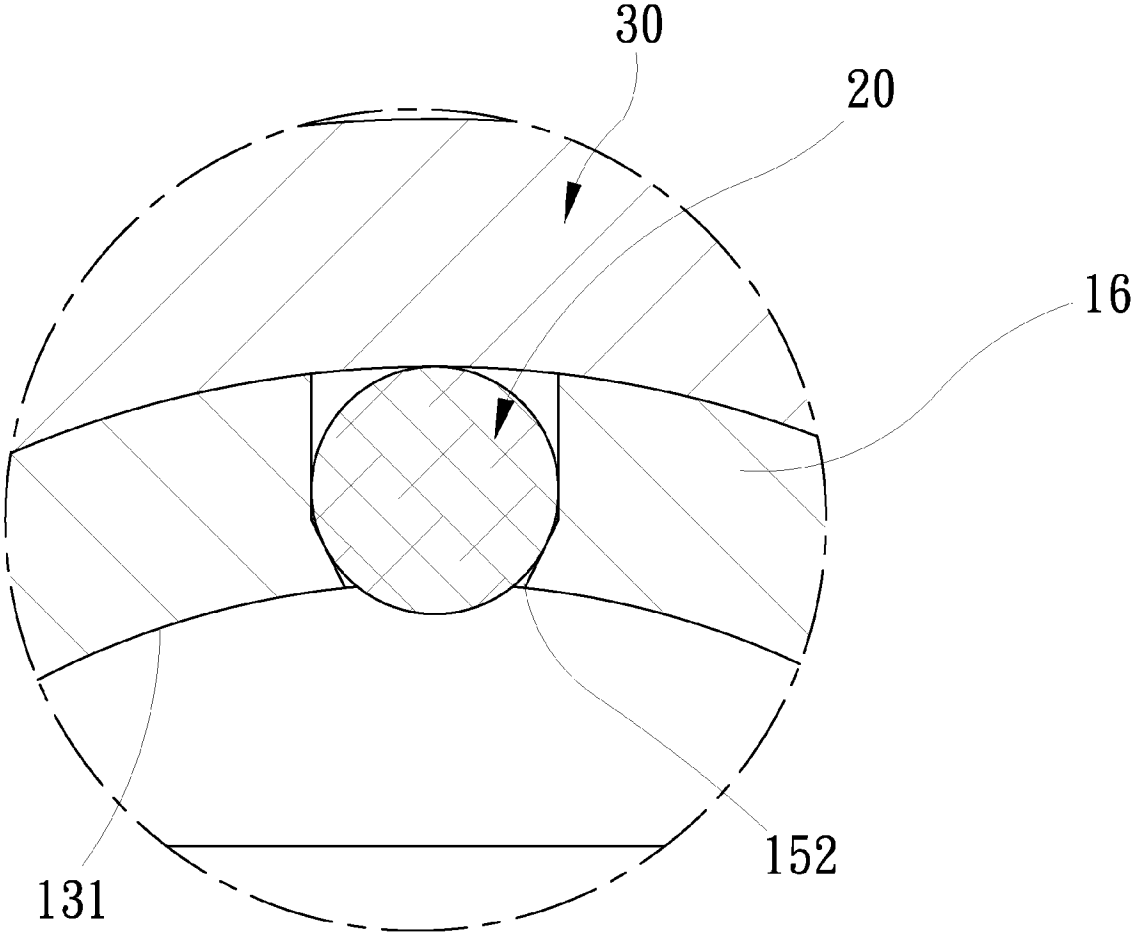
FIG. 5 is an enlarged partial view of the pneumatic tool and the socket apparatus shown in FIG. 4.

Referring to FIGS. 3 through 5, each of the detents 20 is disposed in a related one of the apertures 152. The elastic element 30 is disposed in the groove 15 to bias the detents 20. In detail, the elastic element 30 is in contact with a portion of each of the detents 20 while an opposite portion of the same detent 20 is inserted in the circular section 131 of the mandrel-receiving recess 13. The reduced end of each of the apertures 152 prevents the related detent 20 from completely entering the circular section 131 of the mandrel-receiving recess 13.

A pneumatic tool 200 includes a mandrel consisting of a substantially square section 210 and a circular section 220. A detent 211 is provided on the square section 210 of the mandrel. The mandrel is not inserted in the mandrel-receiving recess 13.

Figure 6:
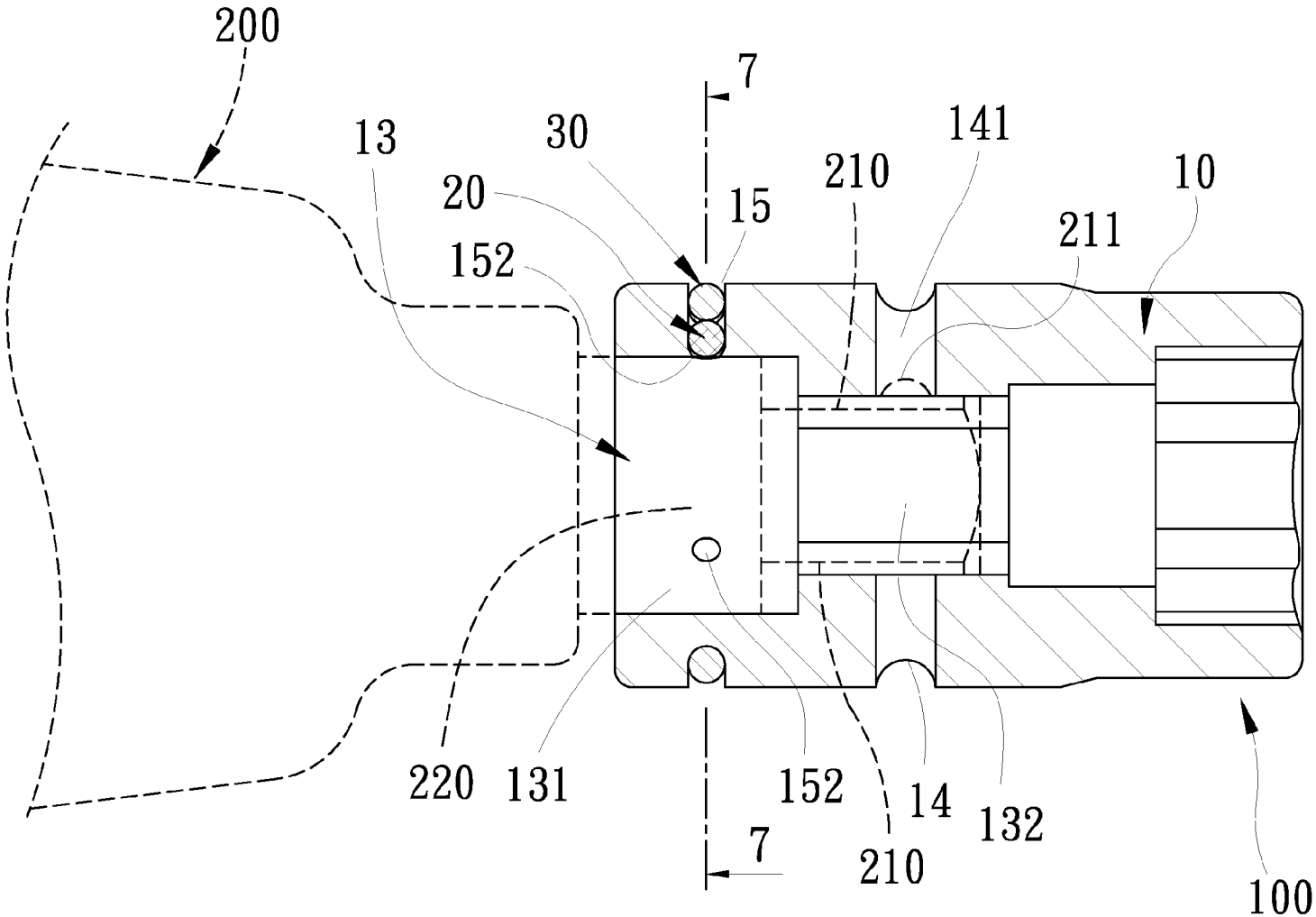
FIG. 6 is a cross-sectional view of the pneumatic tool and the socket apparatus in another position than shown in FIG. 1.
Figure 7:
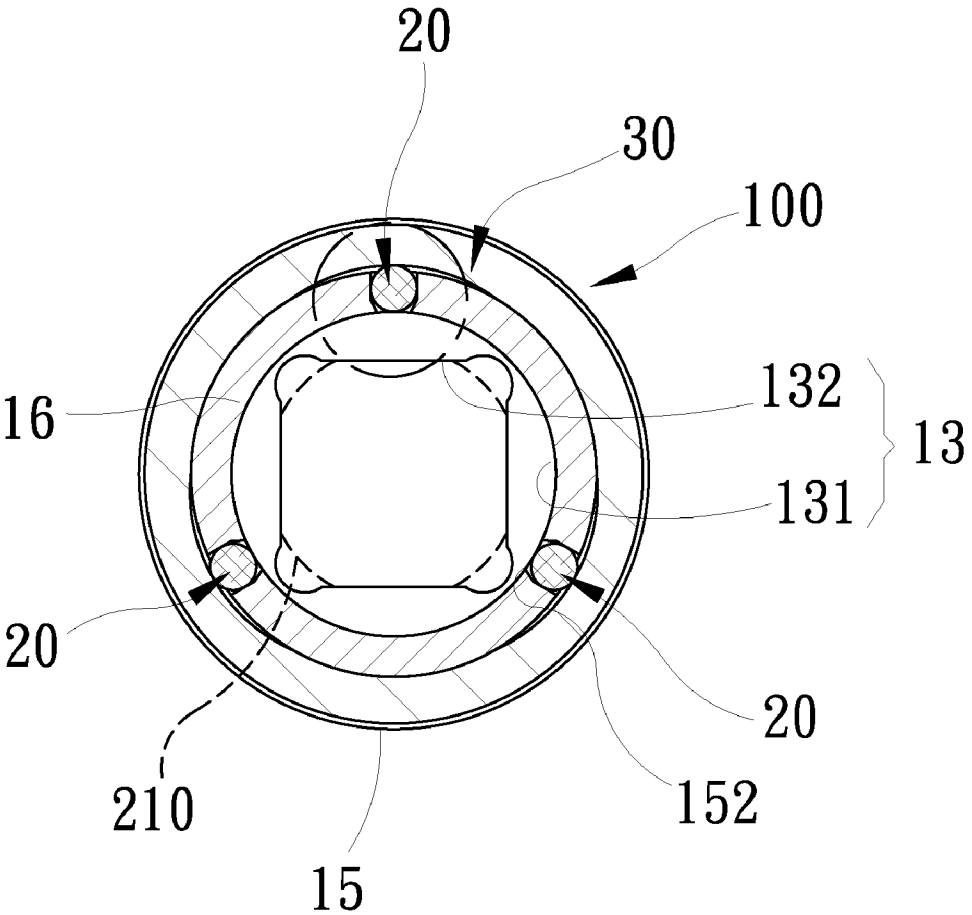
FIG. 7 is another cross-sectional view of the pneumatic tool and the socket apparatus shown in FIG. 6.
Figure 8:
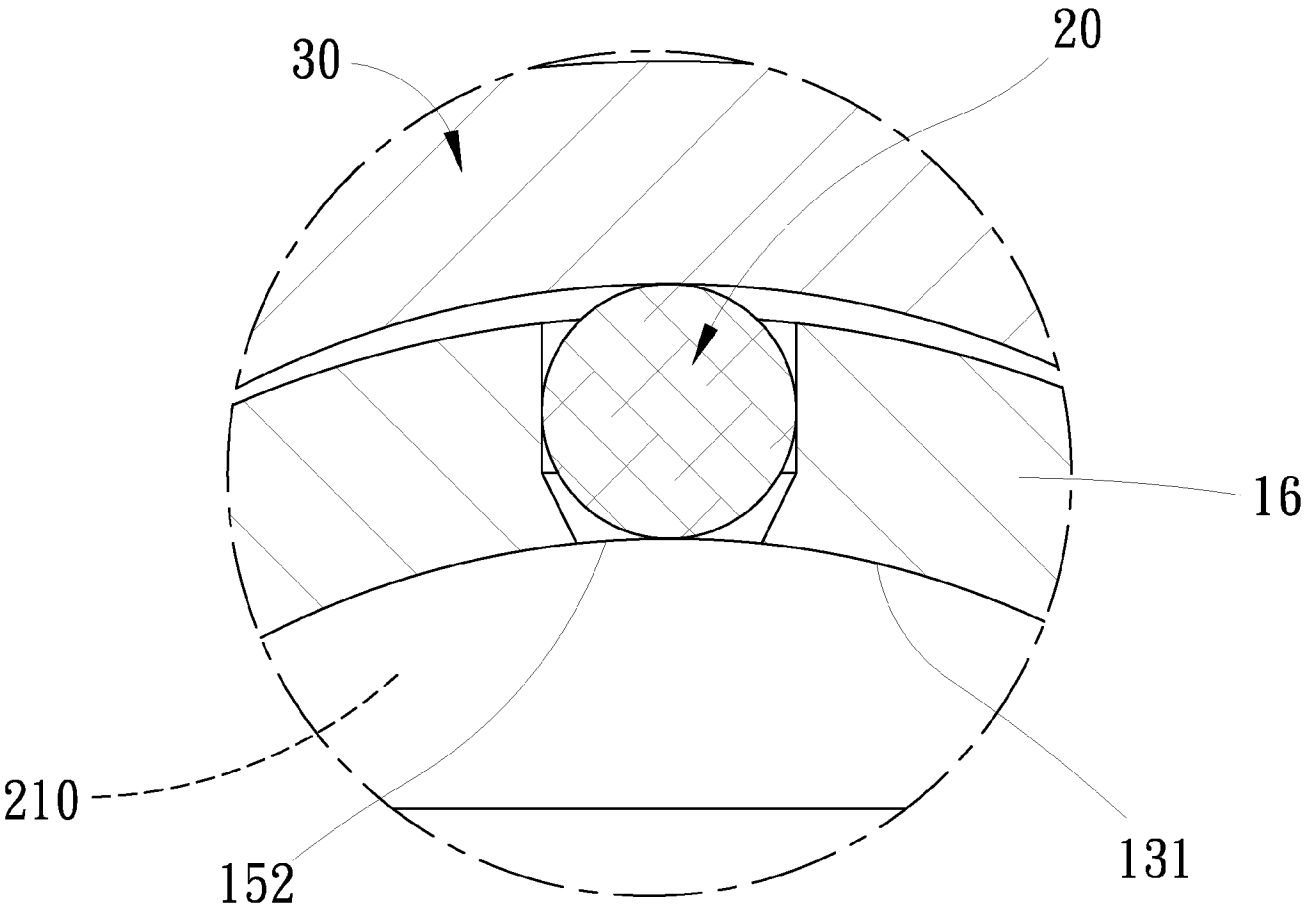
FIG. 8 is an enlarged partial view of the pneumatic tool and the socket apparatus shown in FIG. 7.

Referring to FIGS. 6 through 8, the mandrel is inserted in the mandrel-receiving recess 13. The square section 210 of the mandrel is inserted in the square section 132 of the mandrel-receiving recess 13, and the detent 211 is partially inserted in the vent 141. The circular section 220 of the mandrel is inserted in the circular section 131 of the mandrel-receiving recess 13, and the detents 20 are in contact with the circular section 220 of the mandrel. The socket 10 is kept on the mandrel due to the detent 211 partially inserted in the vent 141 and the detents 20 in contact with the circular section 220 of the mandrel.

Moreover, the length of the mandrel-receiving recess 13 is preferably at least one third of that of the socket 10. Thus, the connection of the socket 10 to the mandrel is firm.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A socket apparatus comprising:

a socket comprising a bit-receiving recess in an end, a mandrel-receiving recess in an opposite end, at least one vent in communication with the mandrel-receiving recess and at least one aperture in communication with the mandrel-receiving recess, wherein the mandrel-receiving recess includes a square section in communication with the vent and a circular section in communication with the aperture;

at least one detent disposed in the aperture so that the detent comprises a portion disposed in the mandrel-receiving recess; and an elastic element for biasing and keeping the detent in the aperture.

2. The socket apparatus according to claim 1, wherein the length of the mandrel-receiving recess is at least one third of that of the socket.

3. The socket apparatus according to claim 1 comprising three detents, wherein the socket includes three apertures each for receiving a related one of the detents.

4. The socket apparatus according to claim 1, wherein the elastic element is an elastic ring.

5. The socket apparatus according to claim 1, wherein the elastic element is a C-clip.

6. The socket apparatus according to claim 1, wherein the socket comprises a groove in communication with the aperture, and the elastic element is disposed in the groove.

* * * * *